United States Patent [19]

Ellis et al.

[11] 4,154,259

[45] May 15, 1979

[54] FIRE HYDRANTS WITH IMPROVED UNITIZED BONNET CONFIGURATION

[75] Inventors: Daniel A. Ellis; Joseph L. Daghe, both of Decatur, Ill.

[73] Assignee: Mueller Co., Decatur, Ill.

[21] Appl. No.: 854,027

[22] Filed: Nov. 22, 1977

[51] Int. Cl.[2] ..... F16K 31/50; F16K 41/00

[52] U.S. Cl. ..... 137/298; 251/268

[58] Field of Search ..... 137/272, 280, 281, 283, 137/284, 287–303; 251/268–270, 355

[56] References Cited

U.S. PATENT DOCUMENTS

| | | | |
|---|---|---|---|
| 394,478 | 12/1888 | Ette | 137/304 |
| 2,018,454 | 10/1935 | Lofton | 137/298 |
| 2,019,919 | 11/1935 | Lofton | 137/298 |
| 3,223,110 | 12/1965 | Mueller et al. | 137/298 |
| 3,380,471 | 4/1968 | Mueller et al. | 137/298 |
| 3,961,642 | 6/1976 | Thomas et al. | 137/272 |
| 4,083,377 | 4/1978 | Luckenbill | 137/296 |

*Primary Examiner*—Martin P. Schwadron
*Assistant Examiner*—Richard Gerard
*Attorney, Agent, or Firm*—Cushman, Darby & Cushman

[57] ABSTRACT

A fire hydrant having a unitized bonnet configuration or assembly which includes a bonnet member, operating mechanism, external driving attachment and lubricant reservoir and which may be installed and removed from the hydrant barrel without the loss of lubricant from the lubricant reservoir therein or without the major disassembly of parts. Additionally, the unitized bonnet assembly is provided with a stop nut member which may be adjustably secured to the end of the valve stem to compensate for small variations in barrel lengths and/or valve stem lengths. The stop nut member is carried within the lubricant reservoir of the bonnet member and is at all times sealed from water in the hydrant and, thus, it may be made of a non-corrosive resistant material such as ductile iron or steel which is less expensive than corrosive resistant material such as brass, bronze or stainless steel. The adjustable connection between the stop nut member and the end of the valve stem is likewise protected from exposure to the water system by being fully contained in the lubricant reservoir system and thus the joint between the two is not subject to corrosion. The stop nut member which reciprocates upon rotation of the operating nut assumes the torsional loads rather than the valve stem.

15 Claims, 5 Drawing Figures

86
80
74
78
68
72
54
66
76
50
70
90
62
64
54
84
10
82
41
85
52
42
92
60
94
48
48
44
108
100
106
40
98
104
46
96
112
102
56
38
22
58
116
114
114
36
116
118
14
120
32

FIRE HYDRANTS WITH IMPROVED UNITIZED BONNET CONFIGURATION

The present invention relates to an improvement in fire hydrants and, more particularly, to an improved unitized bonnet configuration or assembly including a bonnet member, operating mechanism for the hydrant external driving attachment and lubricant reservoir, and which may be, as a unit, easily assembled or disassembled from a hydrant barrel without the loss of lubricant from its lubricant reservoir or the major disassembly of parts. The unitized bonnet assembly includes a stop nut member carried solely within the lubricant reservoir and thus never exposed to the corrosive action of the water system. The stop nut member is arranged to be adjustably secured to the hydrant valve stem to accommodate for variations in barrel lengths and/or stem lengths and the like and the joint between the valve stem and the stop nut member is likewise isolated from the water system.

BACKGROUND OF THE INVENTION

Unitized bonnet assemblies have heretofore been provided for hydrants but in such prior constructions there has always been a part or element of the operating mechanism of the unitized bonnet assembly which is exposed to the water system which necessitates such part or member being made of a non-corrosive expensive material. Further, in such prior arrangements, when it was necessary to remove the unitized bonnet assembly from the hydrant barrel, it was sometimes necessary to break the joint between the valve stem and the element of the bonnet member to which it was attached since such joint was exposed to the waterway and resulted in corrosion between the stem and the element. In other such unitized bonnet assemblies, the removal of the unitized bonnet assembly resulted in loss of lubricant such as oil or the like from the lubricant reservoir and, additionally, these types of unitized bonnet assemblies required the lubricant reservoir to be filled after assembly. Additionally, the connection of these type of unitized bonnet assemblies to the valve stem was such that the torsional loads applied by the operating nut in opening and closing the hydrant valve was transferred through the valve stem to the valve element and to the valve seat. This resulted in the valve seat having to be installed with higher torques. In arrangements where the torque of the operating nut was absorbed in the bonnet, the element absorbing such torque was exposed to the water system thus necessitating it being manufactured from an expensive non-corrosive material.

Such prior constructions are disclosed in the copending United States application of Lawrence F. Luckenbill, Ser. No. 733,853, filed Oct. 19, 1976 now U.S. Pat. No. 4,083,377 and assigned to the same assignee as this application, namely Mueller Co., of Decatur, Ill. Likwise, such prior constructions are shown in the U.S. Pat. No. 3,223,110, issued Dec. 14, 1964, to Frank H. Mueller and John J. Smith and also assigned to the same assignee, Mueller Co., of Decatur, Ill.

PRIOR ART

In addition to the aforementioned co-pending application Ser. No. 733,853 and the aforementioned Mueller et al. U.S. Pat. No. 3,223,110, the following patents also represent prior arrangements of hydrants with bonnet configurations having lubricant reservoirs:

| Patent Number | Name | Date |
|---|---|---|
| 394,478 | Ette | December 11, 1888 |
| 2,019,919 | Lofton | November 5, 1935 |
| 2,018,454 | Lofton | October 22, 1935 |
| 3,380,471 | Mueller et al | April 30, 1968 |

BRIEF SUMMARY OF THE INVENTION

The present invention relates to an improvement in a fire hydrant comprising a barrel member having an opening therein, valve means carried by the barrel member for discharging water from the hydrant and a reciprocating valve stem extending from the valve means toward the opening of the barrel. A unitized bonnet assembly is detachably secured to the barrel member adjacent the opening, the bonnet assembly including a bonnet member having an aperture therethrough with an inwardly extending shoulder therein. A tubular portion extends from around the shoulder through the opening in the barrel member towards the valve means and defines a lubricating chamber. The tubular portion is provided with an opening therein remote from the inwardly extending shoulder of the bonnet member, the opening receiving an end of the reciprocating valve stem. Means are provided on the bonnet assembly for supplying lubricant to the lubricant reservoir. A rotatable operating nut member extends out of the aperture of the bonnet member, the same having an exterior flange thereon which operatively abuts the inwardly extending shoulder in the aperture of the bonnet member. A tubular hold-down nut member is threadedly received in the aperture of the bonnet member and operatively abuts the exterior flange of the operating nut member while permitting the operating nut member to be rotatable. Sealing means are provided between the hold-down nut member and the bonnet member as well as between the hold-down nut member and the operating nut member. A stop nut member is positioned solely within the lubricant reservoir in one position of said valve means and is positioned partially in the opening of the tubular portion in another position of said valve means and means are provided for adjustably securing the stop nut member to the end of the valve stem. The stop nut member is threadedly coupled to the operating nut member and means are provided within the tubular portion of the bonnet member for restraining said stop nut member from rotation while permitting reciprocating movement of said stop nut member when said operating nut member is rotated. Sealing means are provided between the tubular portion of the bonnet member and the reciprocating valve stem, the sealing means isolating the stop nut member and the means adjustably securing the same to the valve stem from water within the barrel member at all times. Further sealing means are carried by the stop nut member and are arranged to seal with the opening in the tubular portion when the stop nut member is in the position where it has a portion thereof extending into the opening in the tubular portion whereby the bonnet assembly may be installed on and removed from the barrel member and the valve stem without the loss of lubricant from the lubricant reservoir.

While the hydrant may be a "wet barrel" hydrant which is one in which the hydrant barrel is always filled with water and the hydrant valve is located at the upper end of the barrel adjacent the nozzle outlet, the hydrant is preferably a "dry barrel" hydrant with the main hydrant valve located in a shoe generally positioned beneath the ground and with the valve stem extending upwardly through the barrel member to the bonnet assembly where it is detachably secured to the operating mechanism thereof, the bonnet assembly being secured as a unit to the upper end of the hydrant barrel.

The unitized bonnet assembly is detachably secured to the barrel member and to the valve stem so that when it is desired to remove and replace or service the bonnet assembly, the flange bolts holding the bonnet assembly to the barrel are removed and then the operating nut is turned until the portion of the stop nut member having the seal thereon makes sealing engagement with the opening in the tubular portion of the barrel member and this prevents loss of lubricant such as oil from the lubricant reservoir.

When the hydrant is a "dry barrel" hydrant, the removal of the bonnet member can be made when there is pressure on the main hydrant valve as the pressure will hold the hydrant valve closed and the stem up as the operating nut is turned so that the bonnet assembly will rise and be disengaged from the valve stem.

By providing means for restraining the stop nut member from rotation and yet permitting reciprocating movement of the same when the operating nut member is rotated, the torsion loads caused by the rotation of the operating nut member are absorbed by the stop nut member rather than by the valve stem. As a result of this, the main valve seat ring assembly can be installed at lower torques which means that it is easier to service the main valve seat ring when it has to be removed. Ancillary to this, the stop nut member also functions as a stop when opening the main hydrant valve thus preventing over-travel of the stem and the hydrant valve and the resulting buckling by compressive loads generated in the stem when the main valve makes contact with the shoe.

DETAILED DESCRIPTION OF THE INVENTION

Figure 1:
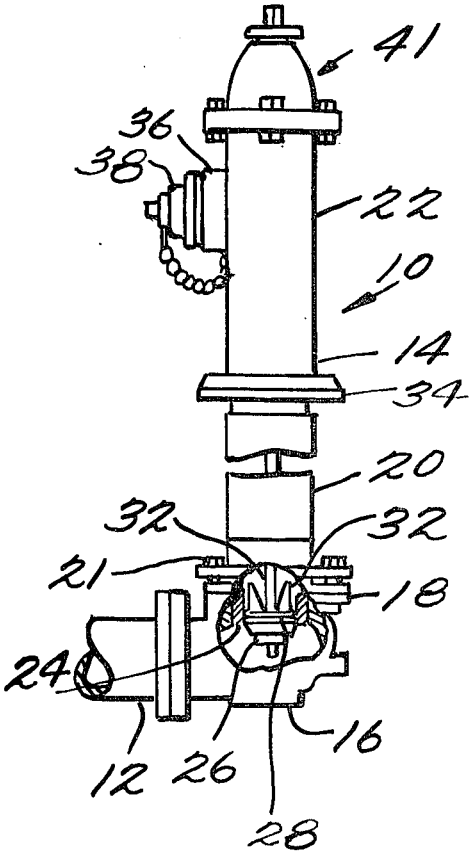
FIG. 1 is a side elevational view partly in cross-section, the view illustrating the fire hydrant of the present invention with the improved unitized bonnet configuration or assembly.

Referring now to the drawings wherein like characters or reference numerals represent like or similar parts, the fire hydrant of the present invention as shown in FIG. 1 is identified generally by the numeral 10 and it is adapted to be connected to a water main 12. The hydrant 10 includes a hydrant barrel member 14 comprising a shoe 16 having an upwardly opening mount surrounded by a peripheral flange 18, a lower barrel section 20 and an upper barrel section 22. The flange 18 of shoe 16 is detachably bolted to the lower end of lower barrel section 20 by bolt members 21 and further, the shoe is provided with the main hydrant valve brass seat ring 24, the brass seat ring having a downwardly frusto-conical seat for seating with a reciprocating main hydrant valve element 26.

The valve element 26 includes on its upper valve plate member 28 at least a pair of longitudinally extending ribs 20 which cooperate with longitudinally extending grooves in the seat ring 24. Extending upwardly from the upper valve plate member 28 is a valve stem 32 which may be sectional, i.e., a lower valve stem and an upper valve stem connected together in the area of the frangible flange connection 34 and, it will now be evident that the ribs 30 permit the valve element 26 and the valve stem 32 to reciprocate vertically but do not permit them to rotate. This is the usual structure found in most modern day fire hydrants.

The upper barrel member 22 has its lower end detachably connected to the upper end of the lower barrel section 20 by means of a frangible flange connection 34. Additionally, the upper barrel section 22 is provided with at least one and preferably more hydrant nozzles 36, each having closures 38 detachably carried thereon.

The hydrant thus far described is commonly referred to as a "dry barrel" hydrant since the main hydrant valve element 26 and its cooperating seat ring 24 is located in the shoe 16 and not at the hydrant nozzles 36. By providing the valve element 26 in the shoe 16 which is buried in the ground well below the freeze line, the hydrant is capable of being used in those areas where it is necessary to protect the hydrant from the possibility of a freeze. While the present invention will be described in connection with a "dry barrel" hydrant, it will be appreciated by those skilled in the art that the present invention could be utilized in a "wet barrel" hydrant which is provided with the main hydrant valve in or at the hydrant nozzles and which is provided with a bonnet member carried by the hydrant barrel in a position oppositely disposed from the hydrant nozzles.

Figure 2:
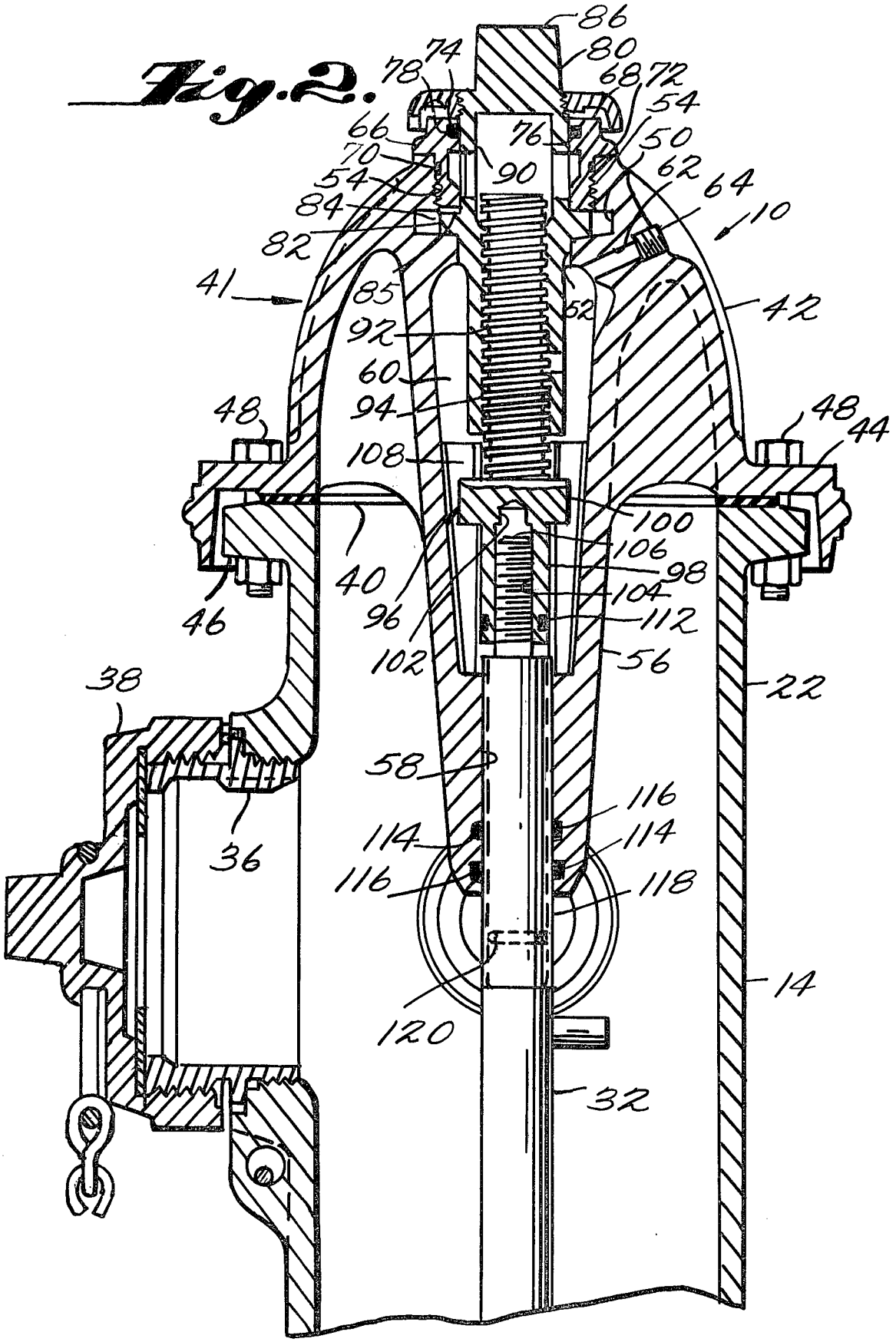
FIG. 2 is an enlarged vertical cross-sectional view through the upper portion of the hydrant of FIG. 1, the view illustrating the unitized bonnet assembly with the valve stem and the stop nut member in the upper position so as to close the main hydrant valve.
Figure 3:
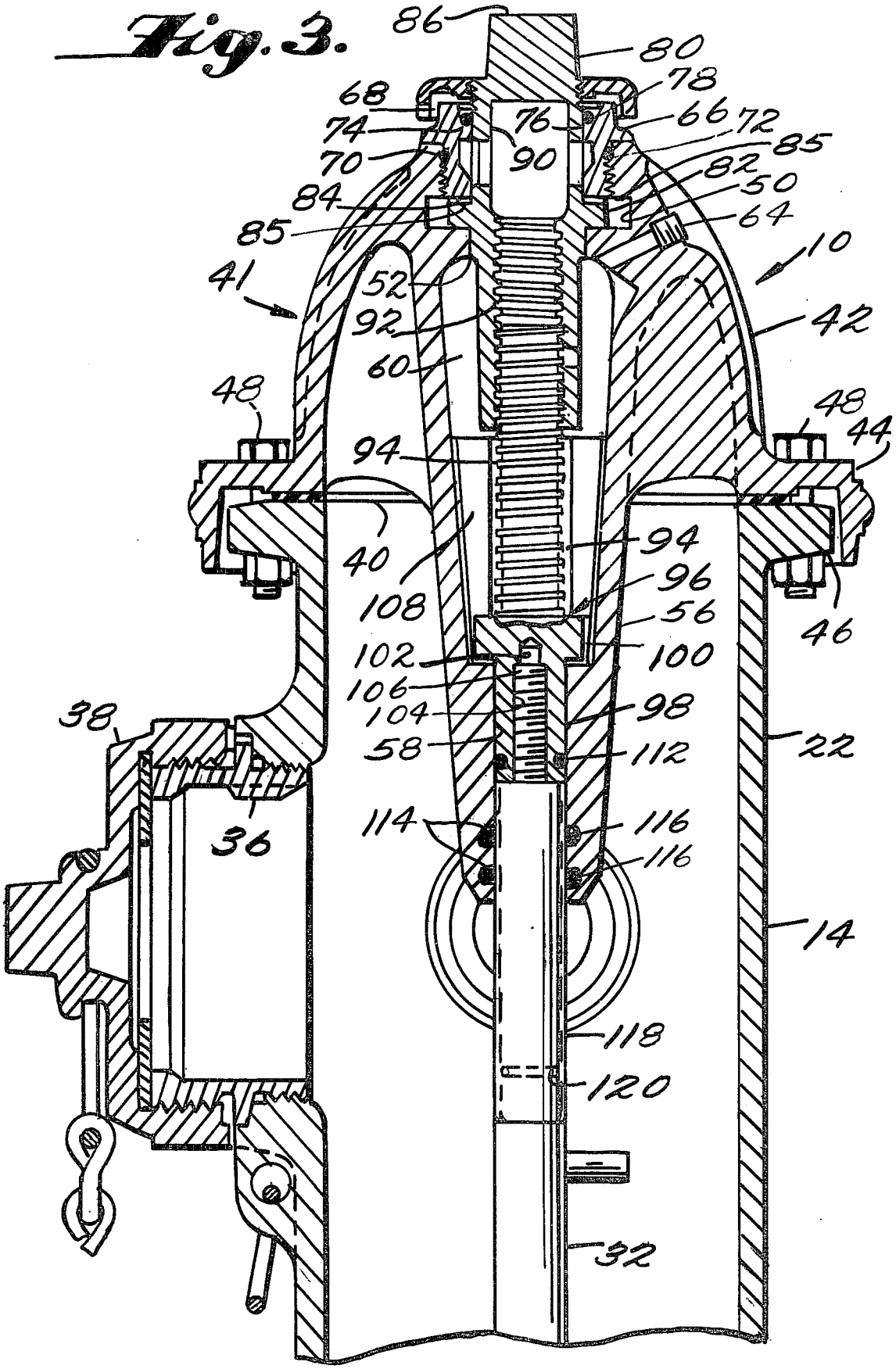
FIG. 3 is an enlarged vertical sectional view similar to FIG. 1 but illustrating the stop nut member of the bonnet assembly and the stem in the lower position wherein the main hydrant valve is open.

Referring now in detail to FIGS. 2 and 3, the upper barrel section 22 of the hydrant barrel member 14 is provided with an open upper end 40 which is closed by a detachable unitized bonnet assembly generally designated at 41 and including a bonnet member 42. The bonnet member 42 is provided with a peripheral flange 44 whereas the upper barrel section 22 is likewise provided with a peripheral flange 46. A plurality of arcuately spaced bolt members 48 extending through mating holes in the flanges 44 and 46 detachably retain the bonnet member 42 on the upper barrel section 22.

The unitized bonnet assembly 41 is a self-contained unit in that it carries all elements or operating mechanism necessary to reciprocate the valve stem 32 and open and close the valve element 28. In this respect, the bonnet member 42 of the bonnet assembly 41 is so designed that it can be attached to and removed from the hydrant barrel member 14 without loss of oil from its lubricant reservoir and the various working elements or operating a mechanism of the bonnet assembly are self-contained within the lubricant reservoir and are never exposed to the water system of the hydrant. This includes the connection of the elements of the bonnet assembly to the upper end of the valve stem 32. By the particular configuration of the unitized bonnet assembly 41, all moving elements are located within the confines of its bonnet member lubricant reservoir and may be made of inexpensive materials such as ductile iron, steel or the like since these elements are not exposed to the corrosive action of water. Additionally, the unitized bonnet assembly 41 further accommodates for variations in valve stem length and barrel length and additionally controls the amount of movement of the valve element so that unnecessary compressive loads will not be created in the valve stem. Ancillary to the foregoing, the bonnet member 42 of the assembly 41 absorbs all torsional loads resulting during operation rather than permitting such torsional loads to be absorbed into the valve stem. In this respect, although the hydrant 10 of the present invention is disclosed as providing means on the valve element 28 for cooperating with means of the seat ring to restrain the stem from rotation while permitting reciprocating movement of the same, these latter mentioned means do not have to be provided since means are provided within the bonnet member for accomplishing the same purpose without transmittal of the torsional loads to and through the valve stem.

The bonnet member 42 is provided with a central aperture 50 extending therethrough from the exterior to the interior thereof. The aperture 50 is provided with an inwardly extending shoulder 52 and an interiorly threaded portion 54 above the shoulder. An elongated downwardly extending tubular portion 56 extends from around and beneath the shoulder 52, the tubular portion 56 having an opening or bore 58 at its lower end. Tubular portion 56 defines a lubricant reservoir 60, the lubricant reservoir terminating just above the bore or opening 58. A passage 62 in the bonnet member extends from the exterior of the bonnet assembly 41 to the lubricant reservoir 60, this passage normally being closed by a plug 64. This passage is used to check and fill the lubricant reservoir in the field. Of course, the passage 62 could extend from the exterior of the bonnet assembly 41 through the operating nut member or the hold-down nut member 66 to the interior of the lubricant reservoir 60.

A tubular hold-down nut member 66 is threadedly received in the threads 54 in bonnet member 42, the hold-down nut member being provided with an outer portion 68 which is noncircular, such as a hexagon or the like for receiving a wrench. The hold-down nut member 66 is provided on its outer periphery with an annular groove 70 positioned just above the threads 54 and beneath the outer portion 68, the groove receiving a sealing ring 72 such as an O-ring that provides a seal between the hold-down nut member 66 and the bonnet member 42. A further annular groove 74 is provided in the aperture or bore 76 of the hold-down nut member 66, the annular inner peripheral groove 74 receiving a sealing ring 78 such as an O-ring which makes a seal between the hold-down nut member 56 and a rotatable operating nut member 80.

The operating nut member 80 includes an exterior annular flange 82 which is arranged to abut the upper face of the inwardly extending shoulder 52 of the bonnet member as well as the lower end 84 of the hold-down nut member 66. A portion 86 of the operating nut member 80 extends out of the bonnet member 42 and is provided with a noncircular cross-section for receiving a wrench to rotate the same. As will now be evident when the hold-down nut 66 is threaded into the bonnet member 42, the hold-down nut member retains the operating nut member 80 against axial movement but permits the operating nut member to be rotated. An anti-wear washer 85 may be imposed between the hold-down nut member and the flange 82 on the operating nut member so that the operating nut member may be easily rotated by application of a wrench to its portion 86.

The operating nut member 82 is provided with a closed bottom bore 90 which is provided partially along its length with interior threads 92. The threads 92 of the operating nut member 80 are arranged to receive exterior threads 94 on a portion of a stop nut member 96. In more detail and referring to FIG. 4, it will be noted that the stop nut member 96 has a lower cylindrical portion 98 in addition to the exteriorly threaded portion 94, the cylindrical portion 98 and the threaded portion 94 being separated by a plurality of radially extending lugs on ears 100. Additionally, the cylindrical portion 98 is provided with an elongated longitudinally extending closed bottom bore 102 with an elongated longitudinally extending closed bottom bore 102 which is interiorly threaded as shown at 104, the threads 104 being arranged to receive a reduced elongated threaded end portion 106 of the valve stem 32. This provides a means for adjustably securing the stop nut member 96 to the valve stem 32 as will be explained in detail later in the specification.

The interior of the downwardly extending tubular portion 56, which defines the lubricant reservoir 60, is provided with longitudinally extending grooves 108 for receiving the lugs 100 of the stop nut member 96. It will now be evident that when the operating nut member 80 is rotated, the stop nut member 96 reciprocates but is restrained from rotation. The torsion loads applied by the operating nut member 80 are assumed through the lugs 100 by the bonnet member 42 and consequently, none of these torsion loads are transferred to the valve stem 32.

The lower cylindrical portion 98 of the stop nut member 96 is of a size to be received in the opening or bore 58 of tubular portion 56 and is provided with an annular peripheral groove 110 which carries a sealing member 112 such as an O-ring thereon. It will be noted in FIG. 2 of the drawings, the valve stem 32 and the stop nut member 96 are in an upper position and, thus, the valve element 26 is seated against the seat ring 24 so as to close the main hydrant valve. The stop nut member 96 is located completely within the interior of the reservoir 60. Water which may happen to be in the barrel member 14 cannot come in contact with the stop nut member 96 or the reservoir 60 because the bore or opening 58 of the tubular portion 56 is provided with a pair of axially spaced annular grooves 114 each of which contains a sealing ring 116, such as an O-ring. The O-rings 116 bear against the exterior of a brass sleeve member 118 which is carried on the end of the valve stem 32. The sleeve member has a sealing ring 120 provided between it and the end portion of the valve stem 32 just as in the aforementioned application Ser. No. 733,853.

Referring now to FIG. 3, it will be noted that the valve stem 32 and the stop nut member 96 are in a lower position of travel and in this position, the valve element 26 has been opened a predetermined amount. In this position, the cylindrical portion 98 of the stop nut member 96 has extended into the bore or opening 58 of the tubular portion 56 and the O-ring 112 provides a seal between the stop nut member 96 and the tubular portion 56. While water will be initially stopped from contact with the stop nut member 96, reservoir 60 and operating nut 80 by the seals 116, the seal 112 will function to maintain the lubricant reservoir 60 sealed when the bonnet assembly 41 is removed or assembled on the hydrant barrel member 14.

Figure 4:
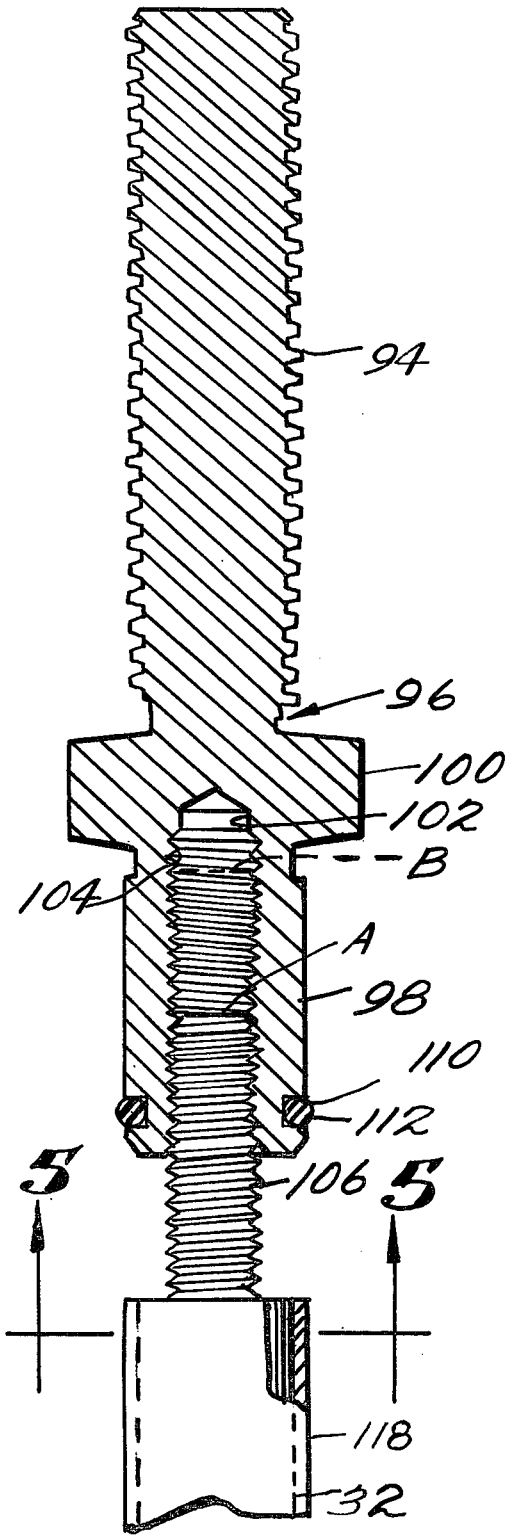
FIG. 4 is an enlarged vertical sectional view, partly in elevation, of the stop nut member of the unitized bonnet assembly of FIGS. 1 through 3.
Figure 5:
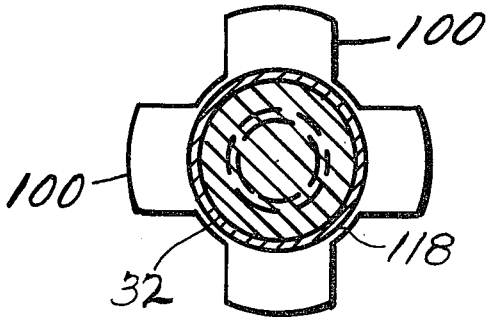
FIG. 5 is a sectional view taken on the line 5—5 of FIG. 4.

If it is desired either to remove the bonnet assembly 41 or to assemble the bonnet assembly onto the barrel member 14, the operator must know the position of the stop nut member 96 if there is to be no leakage of lubricant from the reservoir 60. For example, if it is desired to remove the bonnet assembly 41 as a unit off of the valve stem 32, the operator will initially remove all bolts 48, then the operator will rotate the operating nut member 80 and this will cause the stop nut member 96 to move from the position shown in FIG. 2 to the position shown in FIG. 3 and will cause the bonnet assembly to lift up off of the flange 46 of the barrel member 14. There is no problem in the removal of the bonnet assembly since the valve member 28 will be maintained closed by the water pressure on the same. After the stop nut member 96 bottoms as shown in FIG. 3, and the bonnet member 42 has been lifted off of the barrel member, the entire bonnet assembly may then be rotated to unthread the valve stem 32 from the stop nut member and when this has been completed, the bonnet assembly may be lifted off of the barrel without leakage of lubricant from the lubricant reservoir because the stop nut member now has its seal 112 sealing with the wall of the bore 58 of tubular portion 56. As will now be readily apparent, the bonnet assembly 41 may be assembled in the reverse manner to that referred to above and in each instance, the lubricant will not leak from the lubricant reservoir and, thus, the reservoir does not have to be filled after assembly onto the hydrant. Referring to FIG. 4, by providing an elongated longitudinally threaded portion in the stop nut member 96 for reception of the threaded end 106 of the valve stem 32, the installation of the bonnet assembly 41 onto the barrel member 14 can accommodate for different length barrels and different length valve stems. In FIG. 4 it will be noted that the valve stem 32 has been threaded into the stop nut member 96 to the point A. Assuming this provides proper adjustment of the stop nut member 96 so that the valve stem holds the valve element in closed position, nothing further need be done. However, if either section 20 or 22 of the barrel member 14 or the valve stem 32 are too long, further threading of the end 106 into the bore 104 can move the valve stem 32 upwardly to the point indicated in the broken lines at B. Thus, it will be appreciated that the connection between the valve stem and the stop nut member is adjustable within limits and it will also be appreciated that this connection is at all times isolated from the water system regardless of whether the valve element is open or closed.

The terminology used in this specification is for the purpose of description and not limitation, the scope of the invention being defined in the accompanying claims.

What is claimed is:

1. A fire hydrant comprising:

a barrel member having an opening therein;

valve means carried by said barrel member for discharging water from said hydrant;

a reciprocating valve stem extending from said valve means toward said opening of said barrel;

a unitized bonnet assembly detachably secured to said barrel member adjacent said opening, said bonnet assembly comprising a bonnet member having an aperture therethrough with an inwardly extending shoulder therein and including a tubular portion extending from around said shoulder through said opening into the barrel member toward said valve means and defining a lubricant reservoir, said tubular portion having an opening therein remote from said inwardly extending shoulder for receiving an end of the reciprocating valve stem; means on said bonnet assembly extending from the exterior thereof to the interior of said lubricant reservoir for supplying lubricant to the lubricant reservoir, a rotatable operating nut extending out of the aperture of said bonnet member and having an exterior flange thereon operatively abutting the inwardly extending shoulder in the aperture of said bonnet member, a tubular hold-down nut threadedly received in the aperture of said bonnet member and operatively abutting the exterior flange of said operating nut while permitting the same to be rotatable, sealing means between said hold-down nut and said bonnet member and between said hold-down nut and said operating nut, a stop nut member positioned solely within said lubricant reservoir in one position of said valve means and positioned partially in the opening of said tubular portion in another position of said valve means, means adjustably securing said stop nut member to the end of said valve stem, means threadedly coupling said stop nut member to said operating nut member, means within said tubular portion of said bonnet member for restraining said stop nut member from rotation while permitting reciprocating movement of said stop nut member when said operating nut member is rotated, sealing means between said tubular portion of said bonnet member and said reciprocating valve stem, said sealing means being positioned to isolate said stop nut member and said means adjustably securing said stop nut member to said valve stem from water within said barrel member, and sealing means carried by said stop nut member and arranged to seal with the opening in said tubular portion when said stop nut member is in the position having a portion thereof extending into said opening in said tubular portion whereby said bonnet assembly may be installed on and removed from said barrel member and said valve stem without loss of lubricant from said lubricant reservoir.

2. A fire hydrant as claimed in claim 1 in which said sealing means carried by said stop nut member and arranged to seal with the opening in said tubular portion when the stop nut member is in the position having a portion thereof extending into said opening is an annular groove in the exterior of said stop nut member and a sealing ring in said annular groove.

3. A fire hydrant as claimed in claim 2 in which said sealing means between said tubular portion of said bonnet member and the end of said reciprocating stem includes at least one annular groove on the interior of the opening of said tubular portion and a sealing ring positioned therein for engaging the end of the valve stem at all times.

4. A fire hydrant as claimed in claim 3 in which said opening in said barrel member is positioned at the upper end of said barrel member and in which said valve means is positioned at the lower end of said barrel member and said reciprocating valve stem extends upwardly towards said opening.

5. A fire hydrant comprising:

a barrel member having an open upper end;

valve means positioned in the lower portion of said barrel member;

a reciprocating valve stem extending from said valve means upwardly within said barrel member;

a unitized bonnet assembly detachably secured to the upper end of said barrel member, said bonnet assembly comprising a bonnet member having an aperture therethrough with an inwardly extending shoulder therein and a downwardly extending tubular portion beneath said shoulder and defining a lubricant reservoir, said tubular portion having an opening at its lower end for receiving an upper end of the reciprocating valve stem, a passage extending from the exterior of said bonnet assembly to the interior of said lubricant reservoir, said passage having a removable plug therein, a rotatable operating nut member extending out of the aperture of said bonnet member and having an exterior flange thereon operatively abutting the shoulder in the aperture of said bonnet member, a tubular hold-down nut threadedly received in the aperture of said bonnet member and operatively abutting the exterior flange of said operating nut member while permitting the same to be rotatable, said hold-down nut extending out of said bonnet member, sealing means between said hold-down nut and said bonnet member and said hold-down nut and said operating nut, a stop nut member positioned solely within said lubricant reservoir in one position of said valve means and positioned partially in the opening of said tubular portion in another position of said valve means, means adjustably securing said stop nut member to the upper end of said valve stem, means threadedly coupling said stop nut member to said operating nut member, means within said tubular portion of said bonnet member for restraining said stop nut member from rotation while permitting reciprocating movement of said stop nut member when said operating nut member is rotated, sealing means between said downwardly extending tubular portion of said bonnet member and the upper end of said reciprocating valve stem, said sealing means being positioned beneath said stop nut member and the means adjustably securing the stop nut member to said valve stem whereby the same is isolated from the interior of said barrel member, and sealing means carried by said stop nut member and arranged to seal with the opening in said tubular portion when said stop nut member is in the position having a portion thereof extending into said opening whereby said bonnet assembly may be removed from said barrel member and said valve stem without loss of lubricant from said lubricant reservoir.

6. A fire hydrant as claimed in claim 5 in which said operating nut member includes a closed bottom bore interiorly threaded and in which said stop nut member includes an upper exteriorly threaded portion received in said operating nut member and a lower portion having an elongated closed bottom bore and in which said means adjustably securing said stop member to the upper end of said valve stem includes interior threads in the closed bottom bore of said stop nut member and exterior threads on the upper end of the valve stem.

7. A fire hydrant as claimed in claim 6 in which said means within said tubular portion of said bonnet member for restraining said stop nut member from rotation while permitting reciprocating movement of said stop nut member when said operating nut member is rotated includes elongated longitudinally extending grooves in said tubular portion of said bonnet member and radially extending lugs on said stop nut for movement within said grooves.

8. A fire hydrant as claimed in claim 7 in which said sealing means between said downwardly extending tubular portion of said bonnet member and the upper end of said reciprocating valve stem includes at least one annular groove on the interior of the opening of said downwardly extending tubular portion and a sealing ring positioned therein for engaging the upper end of said valve stem at all times.

9. A fire hydrant as claimed in claim 8 wherein said sealing means carried by said stop nut member and arranged to seal with the opening in said tubular portion is an annular groove on the exterior of said stop nut member and a sealing ring in said annular groove, said sealing ring arranged to seal within the opening in said tubular portion when said stop nut member is in the position having a portion thereof extending into said opening.

10. A fire hydrant as claimed in claim 6 including a sleeve member on the upper end of said valve stem extending downwardly from beneath the exterior threads thereon through and out of the downwardly extending tubular portion of said bonnet member, and including sealing means between the interior of said sleeve member and the exterior of said valve stem.

11. A fire hydrant as claimed in claim 10 in which said stop nut member is made from a non-corrosive resistant material such as ductile iron or steel.

12. A fire hydrant as claimed in claim 11 in which said sleeve member is made from a corrosive resistant material such as brass, bronze or stainless steel.

13. A fire hydrant as claimed in claim 12 in which said valve stem moves downwardly to open said valve means and in which said means adjustably securing said stop nut member to the upper end of said valve stem is adjusted when said valve means is in a closed position.

14. A fire hydrant as claimed in claim 13 in which said lubricant reservoir within said downwardly extending tubular portion of said bonnet member is provided with a shoulder for engaging the lugs on said stop nut member to limit the opening of said valve means.

15. A fire hydrant comprising:

a barrel member having an opening therein;

valve means carried by said barrel member for discharging water from said hydrant;

a reciprocating valve stem extending from said valve means toward said opening of said barrel;

a unitized bonnet assembly detachably secured to said barrel member adjacent said opening, said bonnet assembly comprising a bonnet member having an aperture therethrough with an inwardly extending shoulder therein and including a tubular portion extending from around said shoulder through said opening into the barrel member toward said valve means and defining a lubricant reservoir, said tubular portion having an opening therein remote from said inwardly extending shoulder for receiving an end of the reciprocating valve stem; means on said bonnet assembly extending from the exterior thereof to the interior of said lubricant reservoir for supplying lubricant to the lubricant reservoir, a rotatable operating nut extending out of the aperture of said bonnet member and having an exterior flange thereon operatively abutting the inwardly extending shoulder in the aperture of said bonnet member, a tubular hold-down nut threadedly received in the aperture of said bonnet member and operatively abutting the exterior flange of said operating nut while permitting the same to be rotatable, sealing means between said hold-hown nut and said bonnet member and between said hold-down nut and said operating nut, a stop nut member positioned solely within said tubular portion of said bonnet, means adjustably securing said stop nut member to the end of said valve stem, means threadedly coupling said stop nut member to said operating nut member, means within said tubular portion of said bonnet member for restraining said stop nut member from rotation while permitting reciprocating movement of said stop nut member when said operating nut member is rotated, sealing means between said tubular portion of said bonnet member and said reciprocating valve stem, said sealing means being positioned to isolate said stop nut member and said means adjustably securing said stop nut member to said valve stem from water within said barrel member, and sealing means carried between said stop nut member and said tubular portion of said bonnet, said last mentioned sealing means being arranged to seal the opening in said tubular portion whereby said bonnet assembly may be installed on and removed from said barrel member and said valve stem without loss of lubricant from said lubricant reservoir.

* * * * *